US010420689B1

(12) United States Patent
Foster et al.

(10) Patent No.: US 10,420,689 B1
(45) Date of Patent: Sep. 24, 2019

(54) ADJUSTABLE MANUAL TRANSFER VEST

(71) Applicants: Cathy J Foster, Huntersville, NC (US); Peggy S. Cauthen, Lakewood Ranch, FL (US)

(72) Inventors: Cathy J Foster, Huntersville, NC (US); Peggy S. Cauthen, Lakewood Ranch, FL (US)

( * ) Notice: Subject to any disclaimer, the term of this patent is extended or adjusted under 35 U.S.C. 154(b) by 295 days.

(21) Appl. No.: 15/433,664

(22) Filed: Feb. 15, 2017

Related U.S. Application Data

(63) Continuation-in-part of application No. 14/698,838, filed on Apr. 28, 2015, now Pat. No. 9,642,400, which is a continuation-in-part of application No. 13/901,507, filed on May 23, 2013, now Pat. No. 9,015,880.

(51) Int. Cl.

| | |
|---|---|
| ***A61G 7/10*** | (2006.01) |
| ***A41D 13/00*** | (2006.01) |
| ***A41D 13/12*** | (2006.01) |
| ***A41D 1/04*** | (2006.01) |
| ***A41D 27/20*** | (2006.01) |

(52) U.S. Cl.
CPC ..... *A61G 7/1051* (2013.01); *A41D 1/04* (2013.01); *A41D 13/0007* (2013.01); *A41D 13/1245* (2013.01); *A41D 27/20* (2013.01); *A61G 7/1023* (2013.01); *A61G 7/1038* (2013.01)

(58) Field of Classification Search
CPC .. A61G 7/1051; A61G 7/1023; A61G 7/1038; A41D 27/20; A41D 1/04; A41D 13/1245; A41D 13/0007; D05B 35/066; D05B 35/107; D05B 21/007
See application file for complete search history.

(56) References Cited

U.S. PATENT DOCUMENTS 4,226,474 A * 10/1980 Rupert ..... A47D 15/006 297/465
5,072,457 A * 12/1991 Aronne ..... A41D 13/0007 2/102
5,152,706 A * 10/1992 Fister ..... B63C 9/115 441/106

(Continued)

*Primary Examiner* — Robert G Santos
*Assistant Examiner* — Myles A Throop
(74) *Attorney, Agent, or Firm* — Dorothy S. Morse

(57) ABSTRACT

A one-piece vest garment having a fashionable appearance wearable in public settings, with an adjustable tapered/secure fit providing efficient manual transfer/lift assistance to caregivers with mobility challenged patients at risk for falling and in need of assistance during standing, walking, sitting, or repositioning activities. It provides secure, steady, and controlled patient lifting while promoting good body mechanics for reduced risk of caregiver shoulder, hand, wrist, and back injury. Since the vest more evenly distributes pressure around a patient's body, in lift maneuvers patient skin tears, bruising, and joint dislocations are reduced. It preferably has four fit-adjusting contour straps and double locking D-ring assemblies, including inner front chest strap, inner front waist strap, exterior back shoulder strap, and exterior lower back strap; a double zippered front closure; and eleven hand grip components, four front, five back, and two side, each fixed with circular stitching for sturdiness and durability during transfer/lift maneuvers.

20 Claims, 6 Drawing Sheets

(56) References Cited

U.S. PATENT DOCUMENTS

| | | | | |
|---|---|---|---|---|
| 5,619,751 | A * | 4/1997 | Ray | A41D 13/00 2/102 |
| 6,122,778 | A * | 9/2000 | Cohen | A62B 35/0006 182/3 |
| 9,387,644 | B1 * | 7/2016 | Brennan | B32B 5/06 |
| 9,642,400 | B1 * | 5/2017 | Cauthen | A61G 7/1038 |
| 2004/0242094 | A1 * | 12/2004 | Copp | A41D 13/0007 441/80 |
| 2011/0283446 | A1 * | 11/2011 | Baldauf | A41D 13/0007 2/462 |
| 2012/0137417 | A1 * | 6/2012 | Pease | A41D 13/0007 2/463 |
| 2012/0180205 | A1 * | 7/2012 | Herring | A41D 13/0007 2/463 |
| 2012/0324630 | A1 * | 12/2012 | O'Brien | A41D 27/02 2/236 |
| 2014/0150161 | A1 * | 6/2014 | Nykoluk | A41D 13/0007 2/102 |
| 2014/0237698 | A1 * | 8/2014 | Murphy | A41D 13/0007 2/69 |

* cited by examiner

ADJUSTABLE MANUAL TRANSFER VEST

CROSS-REFERENCES TO RELATED APPLICATIONS

The non-provisional patent application herein relates to a previously filed and still pending U.S. non-provisional patent application filed by the same two inventors. It has the serial number of Ser. No. 14/698,838, was filed on Apr. 28, 2015, and also has the title of "Manual Transfer Vest". While the claims in Ser. No. 14/698,838 have been allowed by an Examiner, the Issue Fee has not yet been paid. Since the invention in the instant patent application herein has overlapping structural similarity to the invention disclosed in serial number of Ser. No. 14/698,838, and common subject matter therewith, the applicants herein respectfully request a grant of domestic priority based upon their previously filed U.S. Ser. No. 14/698,838 for the instant utility patent application herein now being filed that has important safety and manufacturing related improvements. The invention herein and the one in Ser. No. 14/698,838 are also both related to the invention disclosed by the same two inventors in U.S. Pat. No. 9,015,880 B1 issued on Apr. 28, 2015, which was filed on May 23, 2013, has the serial number of Ser. No. 13/901,507, and is also entitled "Manual Transfer Vest".

BACKGROUND OF THE INVENTION—FIELD OF THE INVENTION

The present invention relates to manual patient transfer systems, particularly to a practical and efficient manual transfer/lift device that is designed as a vest to assist the caregiver, family member, or healthcare professional with mobility challenged patients who are at risk for unintentional falls and in need of assistance during standing, walking, sitting, or repositioning activities. With no direct caregiver-patient contact, the present invention vest greatly reduces the risk of patient skin tears, bruising, and joint dislocations during patient transfer and lifting maneuvers. The manual transfer/lift device of the present invention provides secure, steady, and controlled patient lifting while promoting good body mechanics, and decreases the risk of shoulder, hand, wrist, and back strains experienced by caregivers due to the high physical demands of repetitive patient handling maneuvers. Also, the manual transfer/lift device disclosed herein is an attractive garment having the appearance of an article of clothing rather than an obtrusive medical device, and can easily be worn in any public setting comfortably without the patient wearing it feeling self-conscious. In addition, the most preferred embodiment of the manual transfer/lift device herein is a vest garment made from a single piece of material with one inner adjustable contour strap positioned to become secured horizontally across the chest area of the person wearing the vest when upper front fit adjustment is needed to provide a snug vest fit, the vest also having one inner adjustable contour strap positioned to become secured horizontally across the frontal waist area of the person wearing the vest when lower front fit adjustment is needed to provide a snug vest fit, which together or independently help to provide the patient with a custom contoured, tapered, and secure front vest fit for transfer/handling maneuvers. A preferred double zippered front closure allows the present invention vest to comfortably enwrap the entire upper torso of a patient, with the double zippered front closure making it possible for a caregiver to have prompt independent access to each inner contour strap whenever needed. Furthermore, the back of the most preferred manual transfer device herein also provides two adjustable back exterior contour straps, one positioned to become secured horizontally across the shoulders and one positioned to become secured horizontally across the lower back when back fit adjustment is needed to provide a snug vest fit. All four contour straps (front and back) together and/or independently help to provide a tapered and secure vest fit on a patient during transfer/lift maneuvers wherein the unique vest design allows pressure to be concentrated along the patient's middle and upper back, and away from the neck, arms, and shoulder joints of the person wearing it, thus providing complete back support during patient lifting, transferring, and repositioning maneuvers. The most preferred embodiment of the present invention manual transfer/lift device also provides multiple hand grip components, four on the vest front, five on the vest back, and two extending from front-to-back each across a different one of the opposing sides of the vest at waist level. The hand grip components provide the caregiver balance, control, leverage, and proper weight distribution to help lift and transfer a patient securely comfortably and with ease. The hand grip components are preferably made from heavy-duty webbing sewn in straight lines with circular stitching added to ensure sturdiness and durability of strap attachment during patient transfer/handling maneuvers. The vest fabric is also preferably made of a poly cotton twill which is lightweight, breathable, durable, and sturdy. These quality features allows for the patient to comfortably wear the present invention manual transfer device continuously throughout the day, even during periods of rest or napping. The back of the present invention transfer device is also shorter and contoured by design for easily toileting. In addition, the vest fabric is Consumer Product Safety Improvement Act (CPSIA) compliant and Phthalate free. Thus, the present invention vest has several important multi-functional and patient-assistive transfer/lift features that compensate at least in part for fatigue, pain, loss of strength, loss of mobility, and lack of energy in the daily life of moderately mobility-challenged patients or individuals who are still ambulatory but have difficulty in accomplishing repositioning maneuvers on their own, such as but not limited to lateral bed transfers, rising from a prone position into a sitting position, and rising from a sitting position into a standing position. In addition, present invention embodiments may also be employed to assist more severely mobility-challenged patients or individuals in selected applications.

BACKGROUND OF THE INVENTION—DESCRIPTION OF THE RELATED ART

U.S. Center for Disease Control (CDC) statistics have reported that each year in the United States one in three adults age 65 and older suffers a fall, with falls now the leading cause of early death for older U.S. men and women. While not always being an immediate cause of death, falls can cause moderate to severe injuries, such as hip fractures and traumatic brain injuries, which accelerate death. In addition, medical journals and other publicly available medical information have further documented that the total annual estimated medical cost in the U.S. relating to non-fatal, fall-related injuries is more than $10 billion, with $3 billion estimated for hip fractures alone. The average cost per patient during the first year of a hip fracture is at least $25,000, with a lifetime cost of sustaining a hip fracture approaching $100,000 (of which approximately half is spent on nursing home care). By the year 2020, the total annual cost of fall-related injuries in the U.S. is expected to exceed $30 billion. Thus, there is a great unfulfilled need at this time for new ways to prevent falls in older adults, something that the present invention manual transfer/lift vest directly addresses and provides. In addition to patient issues, high physical demands placed on caregivers who handle and move patients, lead to a high rate of musculoskeletal disorders (MSD) among practicing nurses and other caregivers. Work-related MSD, such as back and shoulder injuries, persist as the leading and most costly U.S. occupational health problem for nurses due to the cumulative effect of repeated manual patient-handling activities as well as patient transfers done in extreme static awkward postures. The present invention manual transfer vest is designed and constructed to assist practicing nurses and caregivers in handling and moving patients (obese and non-obese) without injury to themselves or to the patient, including patient fall prevention, with use contemplated by professionals and staff in hospitals, nursing homes, and assisted living facilities, but not limited thereto, as well as by people at home taking care of a family member.

In their observations as Registered Nurses, the inventors herein have found that in addition to obese populations, the elderly and disabled are currently in great need of transfer assistive devices that are better focused on transferring the patient with the highest level of comfort and safety possible, and also provide benefit to the caregiver by reducing the risk of caregiver MSD. Without an assistive device, two or more people are often needed to lift an individual into a standing position, typically using the arms. When two or more people are needed to assist patients, the labor cost of nursing homes and other patient care facilities is increased. Particularly for elderly populations, as well as other populations who require assistance with ambulation, repeated pulling on the arms can be uncomfortable for individuals attempting to stand, and may lead to arm soreness and other injuries. Also, the disabled often do not have the muscular-skeletal capability or coordination to assist a caregiver during attempts to move them, which places more of a physical burden on the caregiver. The present invention transfer assistive device herein, in the form of a vest, is a non-mechanical lift and patient repositioning device intended to reduce the risk and injuries associated with the populations mentioned hereinabove. The main objectives of the present invention are to promote patient safety, dignity, mobility and independence, which in turn will enhance the patient's quality of life. The present invention has been developed with the safety, comfort and well-being of the patient and caregiver in mind. While many prior art transfer assistive devices for patients and others are known, each has undesirable limitations which are overcome by the present invention. The present invention is intended to be worn continuously by patients while movement and mobility challenges exist, even while sleeping, and overcomes all of the disadvantages mentioned hereinabove for the prior art.

BRIEF SUMMARY OF THE INVENTION

The primary objective of this invention is to provide a manual patient transfer assistive device in the form of a vest that is able to transfer an elderly, disabled, or obese patient with the highest level of comfort and safety possible to the patient and the person or persons aiding the patient. It is also an objective of this invention to provide a manual patient transfer assistive device that allows transfer of most elderly, disabled, and obese patients by one person. A further objective of this invention is to provide a manual patient transfer assistive device easily capable of achieving more than one patient transfer function. Another objective of this invention is to provide a manual patient transfer assistive device that allows patient transfers to be done in extreme static awkward postures without injury to the patient or the person aiding the patient. It is a further objective of this invention to provide a manual patient transfer assistive device that consists of well-designed, strong, and durable construction. Furthermore, it is an objective of this invention is to provide a manual patient transfer assistive device with visible and/or concealed size/contouring adjustment means. Another objective of this invention is to provide a manual patient transfer assistive device that is made of soft, lightweight, and easily washable materials. It is also an objective of this invention to provide a manual patient transfer assistive device that is comfortable when a patient is seated or sleeping, and does not interfere with use of a commode. A further objective of this invention is to provide a manual patient transfer assistive device for continuous or near continuous wear by moderately mobility-challenged patients, which has enhanced aesthetic appeal that does not visibly highlight a patient's movement challenges and instead makes patients feel as if they were wearing conventional and/or stylish clothing.

The present invention is a practical, efficient and well-designed manual multi-functional transfer device that is compact, lightweight, and easily capable of achieving more than one patient transfer function. It can be used with moderately mobility-challenged patients, and also used to promote a steady gait for safe patient ambulation. Use can also be extended to more severely mobility-challenged patients in selected applications appropriate to each individual patient's current medical condition. Using the manual transfer vest, one person usually can slowly, gently, evenly, steadily, and in a controlled manner, bring a seated patient into a standing position by positioning themselves in front of the patient wearing the vest and pulling upwardly and forwardly on the two lower vertically-extending and non-adjustable hand grip components on the front of the vest that are closer to the abdominal/mid-section area of the person wearing the manual transfer vest. Should a patient be more difficult to maneuver, two people standing on opposite sides of a seated patient can bring the patient into a standing position by each simultaneously pulling on one of the upper front hand grip components and on one of the upper back hand grip components. Examples of other patient transfer activity that can be accomplished using the present invention include, although not limited thereto, are frontal transfers, lateral bed transfers, controlled stand-to-sit transitions, and repositioning maneuvers. The present invention manual transfer vest has flexible and durable material, which is also preferably lightweight for added patient comfort. However, for use in colder climates, the present invention manual transfer vest may comprise heavier material and/or more layers (permanently installed or removable) for added patient warmth. The preferred double zippered front closure of the present invention manual transfer vest allows for easy on and off access while offering a comfortable fit, and also provides easy and prompt fit adjustment whenever appropriate. Raising a patient to a standing position using the hand grip components of the present invention instead of patient arms, minimizes risk factors that can lead to patient or caregiver injury while increasing comfort for the patient wearing the manual transfer vest during needed handling/transitions. To accommodate differing patient size, and in providing a good fit for patient lifting and transfers, it is contemplated for the present invention manual transfer vest to be commercially available in more than one size, with visible and/or hidden additional size-adjustment means also present, including adjustable contour straps. The manual transfer vest of the present invention helps to minimize risk factors that can lead to patient or caregiver injury, while also offering style and warmth. Its functionality further enhances a patient's or individual's safety, mobility, and stability during ambulation and transfer, while also facilitating independence and maintaining dignity. No invention is known having the same structure and providing the same benefits as the present invention.

BRIEF DESCRIPTION OF THE SEVERAL VIEWS OF THE DRAWINGS

FIG. 1 shows circle reinforcement stitching defining the length dimension of each of the six front hand grip components, and non-circular reinforcement stitching on the angled straps as well as on all non-hand-grip portions formed at least in part from the front vertically-extending and horizontally-extending straps to make certain that the connection between the strap material forming the six front hand grip components and the vest material supporting them remains strong during the lifting of heavy patients and all patient lifting that occurs from static and sometimes awkward positions.

FIG. 3 shows two horizontally-extending exterior contour straps each positioned in spaced-apart relation to a locking double D-ring assembly for use in size, tapering, and contour adjustment of the vest back material for a snug fit around the person wearing it, both contour straps and both double D-ring assemblies being secured to the vest back material by and between the two vertically-extending back straps with the upper contour strap and double D-ring assembly secured at least in part by the attached/strengthening non-hand-grip area between the upper and lower vertically-extending hand grip components and the lower contour strap and double D-ring assembly secured at least in part an attached/strengthening non-hand-grip area engaging, or located near the top edge of, the horizontally-extending strap, the vest back shown in FIG. 3 further displaying circle reinforcement stitching defining the length dimension of each of the five back hand grip components, in addition to non-circular reinforcement stitching on the angled straps as well as on all other portions of the vertically-extending and horizontally-extending back straps to make certain that the connection between the material forming the five back hand grip components and the vest material remains strong during the lifting of heavy patients and patient lifting that occurs from static and sometimes awkward positions.

COMPONENT LIST

1—most preferred embodiment of manual transfer vest (preferably one-piece construction that comprises front vest material 2 and back vest material 13 as a one-piece unit)

2—front vest material

3—front closure (preferably double zippered so that opening thereof can occur top-to-bottom using top zipper pull 20A, as well as bottom-to-top using bottom zipper pull 20B, for added vest comfort while seated as well as prompt and easy adjustment of vest 1 fit through use of front inner contour straps 23A and 23B whenever needed)

4—first vertically-extending lifting/transfer strap (preferably has one-piece construction for enhanced patient safety, with 4A designated as the front portion thereof and 4B designated as the back portion thereof)

4'—second vertically-extending lifting/transfer strap (preferably has one-piece construction for enhanced patient safety, with 4A' designated as the front portion thereof, while 4B' is designated as the back portion thereof)

5—angled reinforcement strap

6—enlarged arm hole (for comfort and to prevent a sense of restriction around a patient's shoulder area should the vest material undergo any shift in position relative to the patient during a transfer)

7—enlarged neck opening (for comfort and to prevent a sense of restriction around a patient's neck should the vest material undergo any shift in position relative to the patient during a transfer)

8—edge binding material (used to preserve the integrity and longevity of front vest material 2 and back vest material 13 during cleaning and use)

Figure 2:
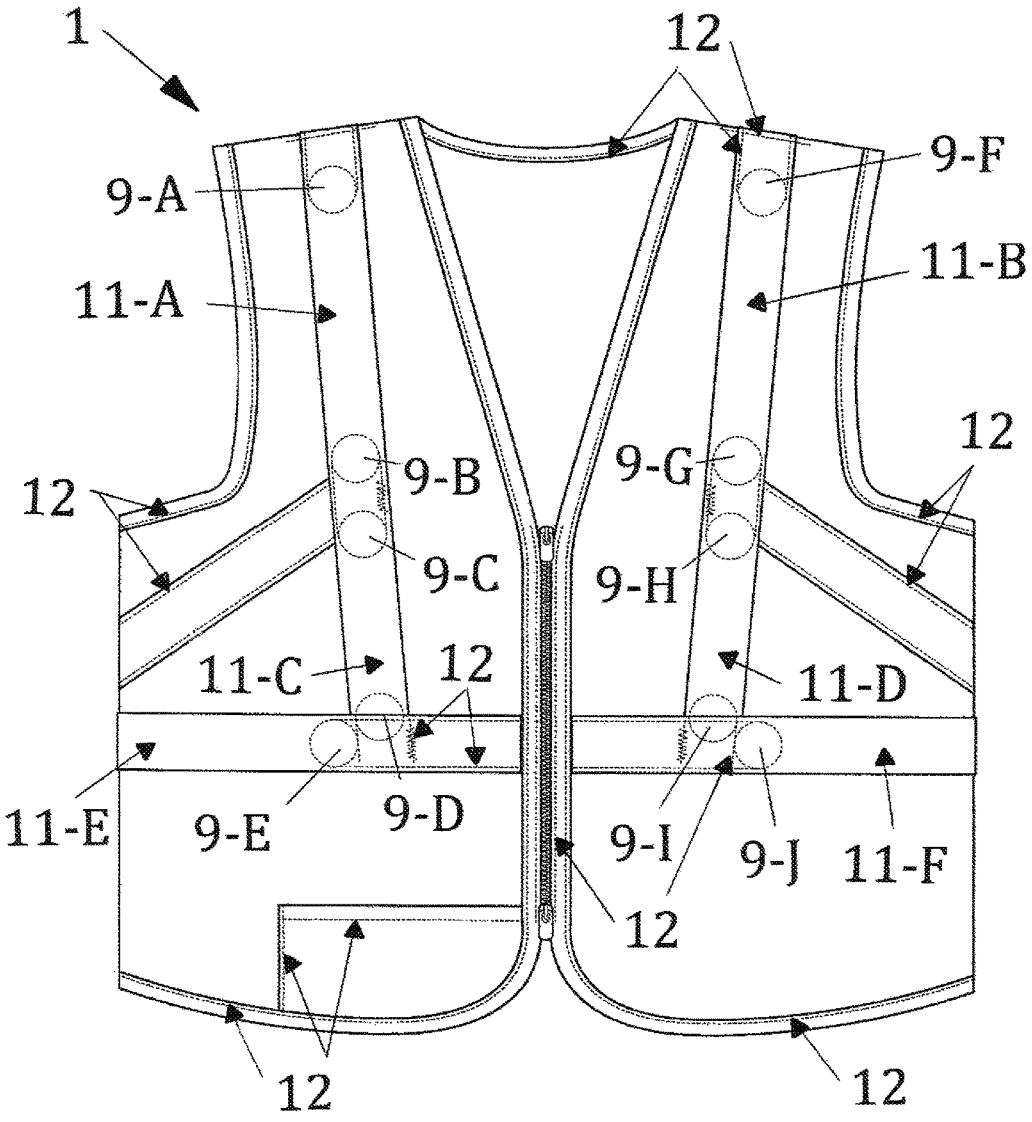
FIG. 2 is a front view identical to that shown in FIG. 1, with numbering that substantially identifies preferred locations of hand grip components and also preferred locations for areas of circular and non-circular stitching.
Figure 4:
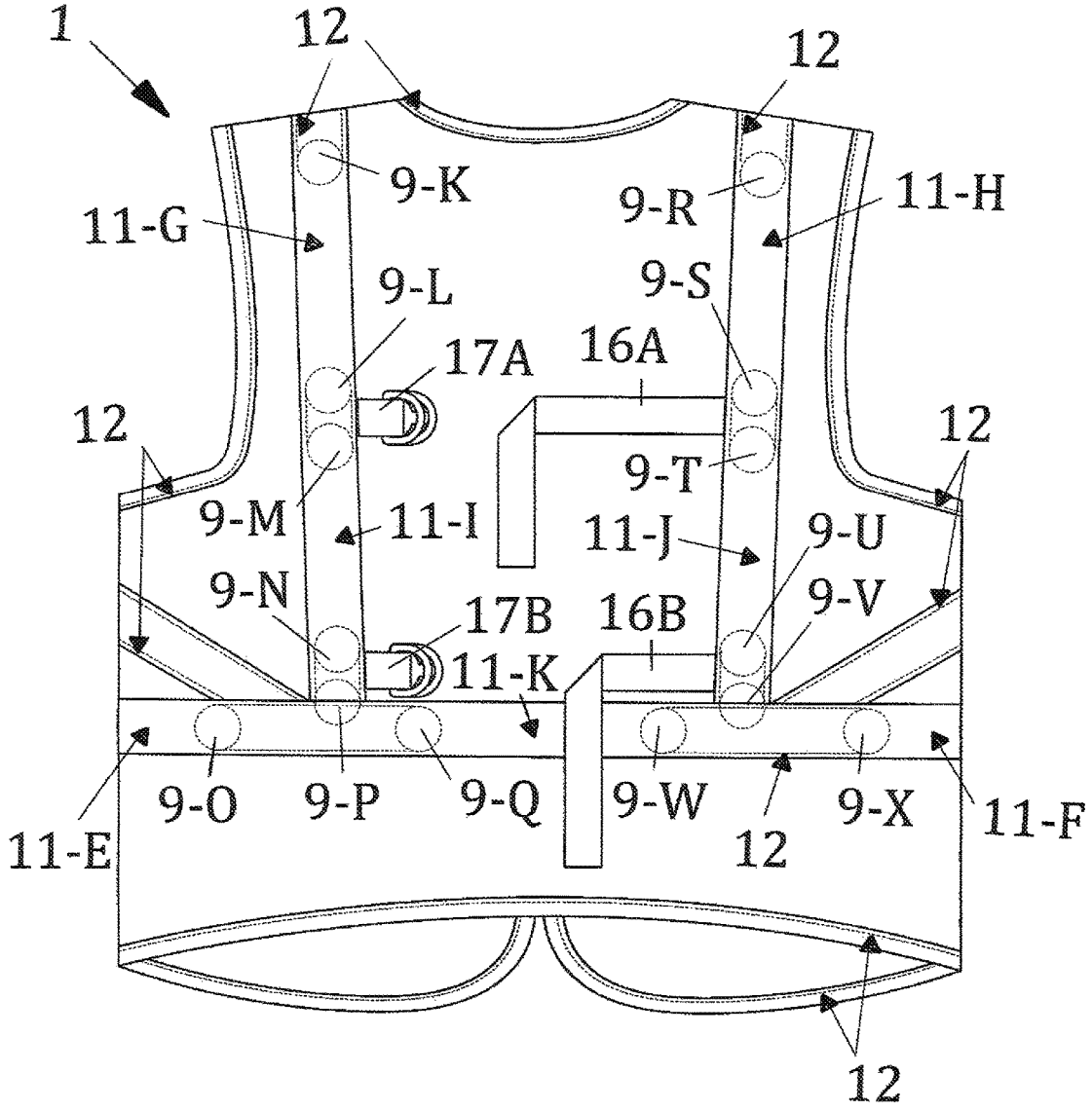
FIG. 4 is a rear view identical to that shown in FIG. 3, with numbering that substantially identifies preferred locations of hand grip components and also preferred locations for areas of circular and non-circular stitching.

9—area of circular stitching defining the ends and length of hand grip components 11-A to 11-K (circular stitching is identified in FIGS. 2 and 4 by the numbers 9-A to 9-X)

10—front void space formed when double zippered front closure 3 is closed (provides user comfort while the individual wearing vest 1 is seated and also allows the two opposed edges in the lower portion of front vest material 2 on each side of the void space to be easily grasped by the user or a caregiver to pull down front vest material 2 during or after a patient transfer is made so that the lower front part of enlarged neck opening 7 does not become, or remain, uncomfortably positioned against the patient's neck)

11—non-length-adjustable/fixed-length hand grip component (created from a portion of vertically-extending straps 4 and 4' or horizontally-extending lower strap 19A, 19A', and 19B, with hand grip component 11-A situated near the patient's right clavicle, hand grip component 11-B situated near the patient's left clavicle, hand grip component 11-C situated near the right side of the patient's abdomen, hand grip component 11-D situated near the left side of the patient's abdomen, hand grip component 11-E situated near the patient's right hip, hand grip component 11-F situated near the patient's left hip, hand grip component 11-G situated near the patient's left shoulder, hand grip component 11-H situated near the patient's right shoulder, hand grip component 11-I situated near the left side of the patient's back, hand grip component 11-J situated near the right side of the patient's back, and hand grip component 11-K situated centrally near waist level on the patient's back)

12—non-circular attachment stitching (used for securing part of both angled reinforcement straps 5, double zippered front closure, and the parts of the 4A and 4A' portions of vertically-extending straps 4 and 4' not creating hand grip components 11 to front vest material 2, securing parts of the 4B and 4B' portions of vertical straps 4 and 4' not creating hand grip components 11 to back vest material 13, securing part of both angled reinforcement straps 5 to back vest material 13, securing the side of an optional pocket 15 to front vest material 2, and securing edging 8, front inner contour straps 23A and 23B, and front inner double D-ring closure assemblies 24A and 24B to front vest material 2, and also securing edging 8, back exterior contour straps 16A and 16B, and back exterior double D-ring closure assemblies 17A and 17B to back vest material 13)

13—back vest material

14—shortened/contoured bottom edge of back vest material 13 (prevents patient from uncomfortably sitting on a portion of back vest material 13 and interference during patient use of a commode while continuing to wear vest 1)

15—pocket secured to front vest material 2 (optional, and variable in size, shape, and number)

16A—upper back exterior contour strap

16B—lower back exterior contour strap

17A—upper back exterior double D-ring closure assembly with attachment tab (double D-ring closure assemblies are preferably secured in a position against front vest material 2 or back vest material 13 that is appropriate to engage the distal end of a contour strap 16 or 23 to horizontally extend contour strap 16 or 23 and cause front vest material 2 or back vest material 13 to be drawn in, and further gathering vest material 2 or back vest material 13 until a tapered and secure fit thereof is provided on a patient for transfer/lift maneuvers)

17B—lower back exterior double D-ring closure assembly with attachment tab (similar structure and function to that of assembly 17A)

Figure 6:
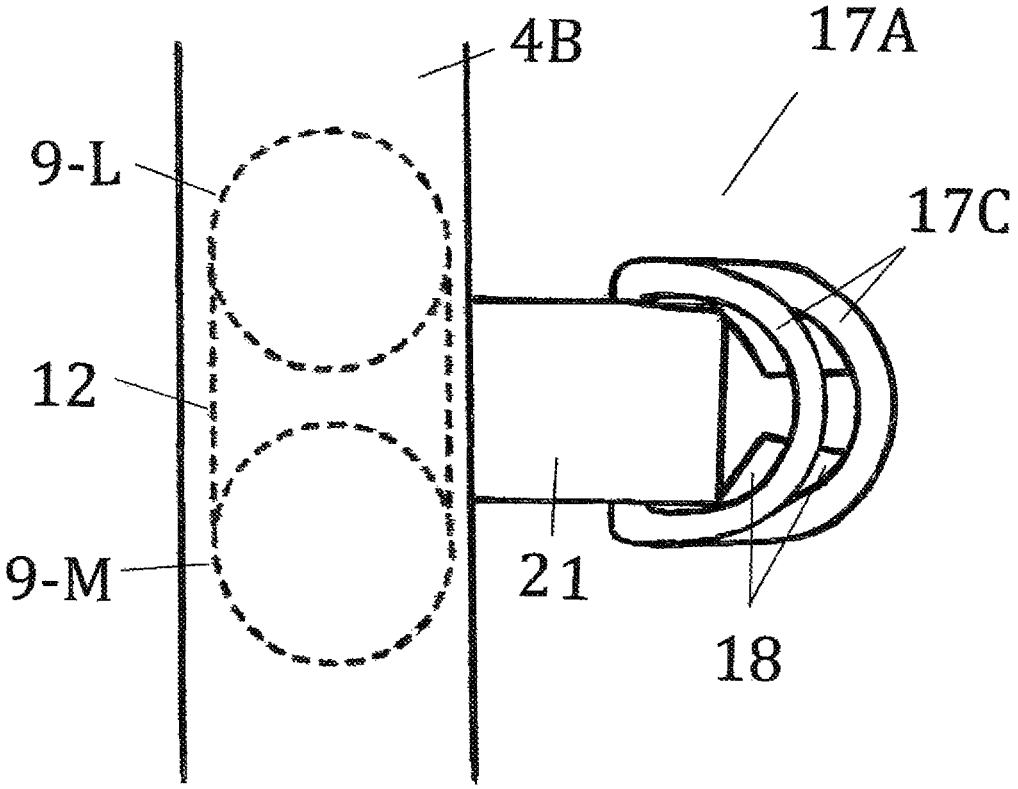
FIG. 6 is an enlarged top view of the locking double D-ring assembly in the most preferred embodiment of the present invention that illustrates one preferred attachment option for the locking double D-ring assembly to a vertically-extending back strap.

17C—locking double D-rings (see enlarged view in FIG. 6, used in assemblies 17A, 17B, 24A, and 24B)

18—locking tab (two opposed tabs 18 are preferably formed laterally on the inside curvature of each D-ring 17C used as a part of present invention double D-ring closure assemblies 17A, 17B, 24A, and 24B to provide non-slip engagement of D-rings 17C with the distal end of a contour strap 16 or 23 during horizontally-extending use thereof in combination with a double D-ring closure assembly 17A, 17B, 24A, or 24B to provide a tapered and secure fit of front vest material 2 and/or back vest material 13 on a patient for transfer/lift maneuvers)

19—horizontally-extending strap (preferably has one-piece construction for enhanced patient safety, with 19A and 19A' designated as the front portions of strap 19, while 19B is designated as the back portion of strap 19, with strap 19 also displaying circular stitching 9 that defines the length of each non-length-adjustable hand grip component (11-E, 11-F, and 11-K) formed from, and as a part of, strap 19)

20A—top zipper pull (for double zippered front closure 3)

20B—bottom zipper pull (for double zippered front closure 3)

21—attachment tab (fastening member used to firmly secure a pair of locking double D-rings 17C to front vest material 2 or back vest material 13 in a position adjacent to one of the vertically-extending straps 4 or 4' and also in a position of engagement with the distal end of a contour strap 16 or 23 during horizontally-extending use thereof to adjust the fit of vest 1 snugly around the torso of a patient for transfer maneuvers)

22—interior surface of said front vest material 2 (visible through neck opening 7 and from the rear of vest 1 below the shortened/contoured bottom edge 14 of back vest material 13)

23A—upper front inner contour strap

23B—lower front inner contour strap

24A—upper front inner double D-ring closure assembly with attachment tab (similar structure and function to that of 17A, 17B, and 24B)

24B—lower inner front double D-ring closure assembly with attachment tab (similar structure and function to that of 17A, 17B, and 24A)

DETAILED DESCRIPTION OF THE INVENTION

The present invention is a practical and efficient manual transfer/lift device most preferably structured/configured as shown in the vest 1 illustrated in the accompanying FIGS. 1-6. However, while the written description of the manual transfer/lift device herein is intended to enable one of ordinary skill to make and use its best mode, it should also be appreciated that the invention description herein only provides examples of selected embodiments and methods related thereto, and many variations, combinations, and equivalents of the present invention also exist which are not specifically mentioned. Thus, the present invention should therefore not be considered as limited only to the embodiments, methods, and examples specifically described herein, or the language in the accompanying Abstract, but instead as encompassing all embodiments and methods within the scope and spirit of the invention, as defined in the accompanying claims. Therefore, when one encounters the term "vest 1" hereinafter in this invention disclosure, it should be considered as identifying all embodiments within the spirit and scope of the present invention, unless the specific context used suggests otherwise.

The present invention vest 1 is designed to assist the caregiver, family member or healthcare professional with mobility challenged patients (not shown) who are at risk for unintentional falls and in need of assistance during standing, walking, sitting or repositioning activities. With no direct caregiver-patient limb contact during transfer/lift maneuvers, vest 1 reduces the risk of patient skin tears, bruising, and joint dislocations. Vest 1 also provides secure, steady and controlled patient lifting while promoting good body mechanics and decreases the risk of shoulder, hand, wrist, and back strains experienced by caregivers due to high physical demands of repetitive patient handling maneuvers. Furthermore, vest 1 is an attractive garment that has the appearance of an article of clothing rather than an obtrusive medical device and can easily be worn in any public setting comfortably without the patient feeling self-conscious. In addition, vest 1 is preferably a one-piece garment with one horizontally-extending inner adjustable contour strap 23A across a patient's chest area and one horizontally-extending inner adjustable contour strap 23B across a patient's frontal waist area, a double zippered front closure 3 allowing vest 1 to enwrap the entire upper torso of a patient and have a snug fit, and two adjustable horizontally-extending exterior back contour straps (16A across a patient's shoulders and 16B across a patient's lower back). All four contour straps (23A, 23B, 16A and 16B) help to provide a tapered and secure vest fit on a patient wherein vest 1 design allows pressure applied to the patient wearing it during transfer/lift maneuvers to be concentrated along the patient's middle and upper back, and away from the neck, arms, and shoulder joints, providing complete back support during patient lifting, transferring, and repositioning maneuvers.

The most preferred embodiment of the present invention manual transfer/lift vest 1 also offers eleven non-adjustable hand grip components 11, including four front vertically-extending hand grip components (11-A, 11-B, 11-C, and 11-D) each formed as a part of one of the vertically-extending front straps (4A or 4A') and secured on each of its ends to front vest material 2. In addition, four back vertically-extending hand grip components (11-G, 11-H, 11-I, and 11-J) are each formed as a part of one of the vertically-extending back straps (4B or 4B') and secured on each of its ends to back vest material 13. One additional hand grip component secured on each of its ends to back vest material 13 is the horizontally-extending central back hand grip component (11-K) formed centrally from, and as a part of, horizontally-extending back strap 19B. The last two hand grip components used as a part of the most preferred embodiment of the present invention are two horizontally-extending lateral/side/hip hand grip components (11-E and 11F) formed as a part of horizontally-extending back straps (19A, 19A', and 19B) and secured on one end to front vest material 2 adjacent to a patient's frontal waist and on its opposing end adjacent to the lower back portion of back vest material 13. The hand grip components 11-A to 11-K provide a caregiver with balance, control, leverage and the proper weight distribution to help lift and transfer a patient securely, comfortably, and with ease. The hand grip components 11-A to 11-K are preferably made from heavy-duty webbing sewn in part with non-circular attachment stitching 12 and also defined in length by circular stitching (9-A to 9-X, see FIGS. 2 and 4) added to ensure sturdiness and durability of attachment to front vest material 2 and back vest material 13 respectively for vertically-extending and horizontally-extending straps (4A/4A'/4B/4B' and 19A/19A'/19B) during patient maneuvers.

The fabric of the most preferred embodiment of vest 1 is a poly cotton twill which is lightweight, breathable, durable, and sturdy. These quality features allows a patient to wear vest 1 continuously throughout the day, even during periods of rest or napping. The shortened bottom edge 14 of back vest material 13 is also contoured by design to avoid the patient from becoming uncomfortably seated on a portion of it, and for easily toileting. In addition, the fabric of vest 1 is Consumer Protection Safety Information Act (CPSIA) compliant and Phthalate free. Thus, vest 1 has several multi-functional and patient-assistive transfer/lift features that compensate at least in part for fatigue, pain, loss of strength, loss of mobility, and lack of energy in the daily life of moderately mobility-challenged patients or individuals who are still ambulatory but have difficulty in accomplishing repositioning maneuvers on their own, such as but not limited to lateral bed transfers, rising from a prone position into a sitting position, and rising from a sitting position into a standing position. However, vest 1 may also be used by a caregiver to assist more severely mobility-challenged patients or individuals in selected applications that are appropriate to the patient's current medical condition.

The most preferred embodiment of the present invention is the manual multi-functional patient transfer vest 1 shown in FIGS. 1-6, which has multiple patient interfaces accessible from the front, sides, and back of a patient, preferably including the eleven non-adjustable hand grip components 11-A to 11-K shown in FIGS. 1-5. The vertically-extending straps identified in FIGS. 1 and 3 as 4A, 4B, 4A', and 4B', and the horizontally-extending straps 19A, 19A', and 19B also shown in FIGS. 1 and 3, and from which non-adjustable hand grip components 11-A to 11-K are formed, each preferably have a front-to-back one-piece vertically-extending or horizontally-extending construction, with a first vertically-extending strap 4 formed as a one-piece continuous unit from strap segments 4A and 4B, a second vertically-extending strap 4' formed as a one-piece continuous unit from strap segments 4A', and 4B', and a horizontally-extending strap 19 formed as a one-piece continuous unit from strap segments 19A, 19A', and 19B.

Figure 1:
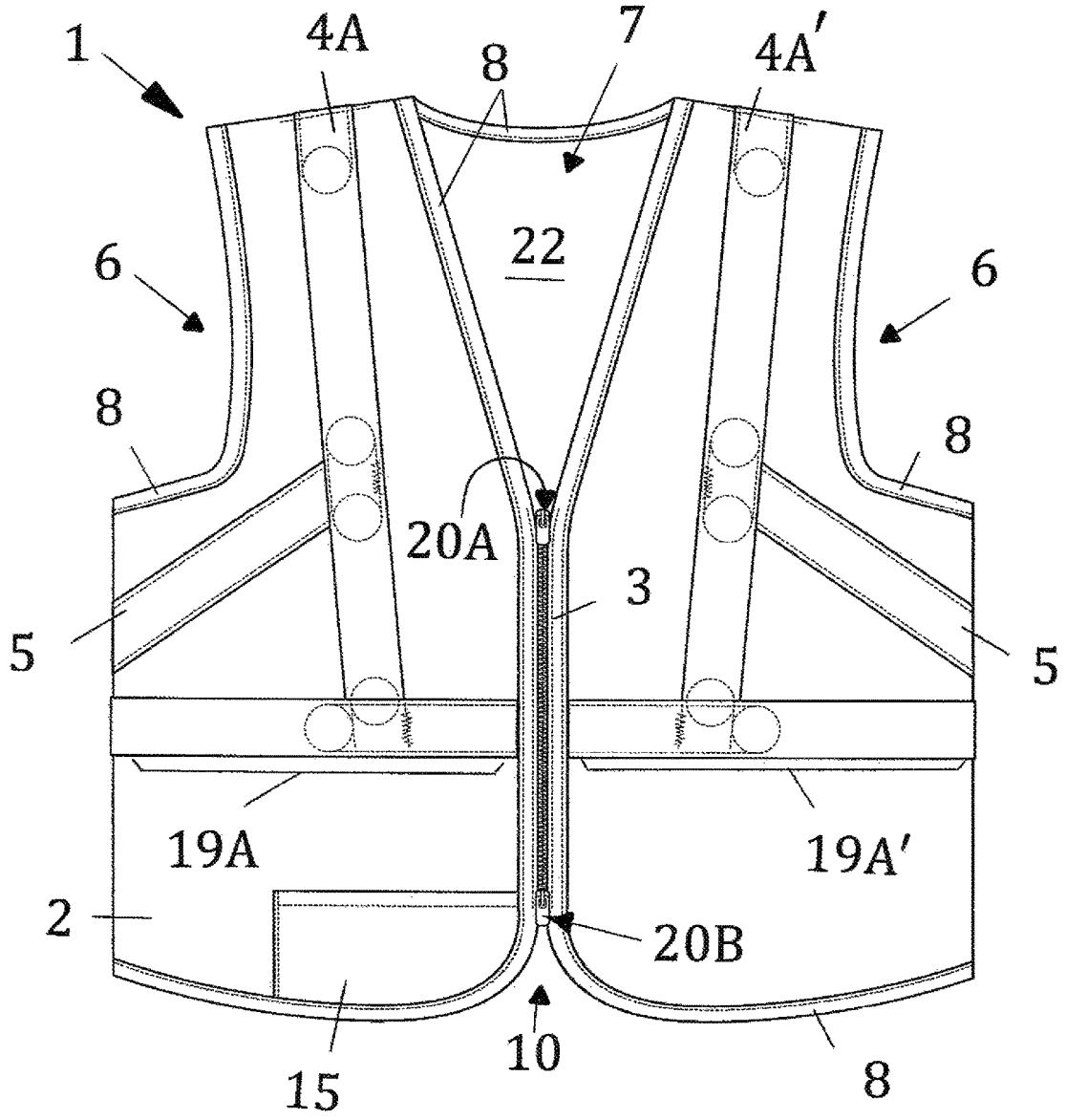
FIG. 1 is a front view of the most preferred embodiment of the present invention manual transfer vest with component-identifying numbers showing a closed double zippered front closure, edge binding material around all non-zippered openings of the vest, an optional pocket attached to the vest front material adjacent to the lower end of the double zippered front closure, two vertically-extending front straps each forming a pair of vertically spaced-apart and non-adjustable hand grip components, each hand grip pair having an upper hand grip component located in the clavicle/upper chest area of the person wearing the vest and a lower hand grip component located in the abdominal/mid-section area of the person wearing the vest, the vest front also displaying two horizontally-extending front straps each located on a different side of the vertically-extending double zippered front closure and securing the bottom ends of the vertically-extending front straps firmly against the vest front material, each horizontally-extending strap also forming in part the front portion of a different one of a pair of horizontally-extending side hand grip components that each continues across a different side of the vest and partially across the vest back material, as shown in FIGS. 3 and 4, the vest front shown in FIG. 1 further displaying the upper portions of two angled pressure/force distributing reinforcement straps each firmly secured to the vest front material on a different side of the centrally located double zippered front closure and also extending laterally and downwardly away from the attached/strengthening non-hand-grip area located between a different pair of upper and lower hand grip components, each angled reinforcement strap continuing around a different side of the vest and onto the vest back material where its bottom end preferably becomes secured by and behind the horizontally-extending back strap, and in addition
Figure 3:
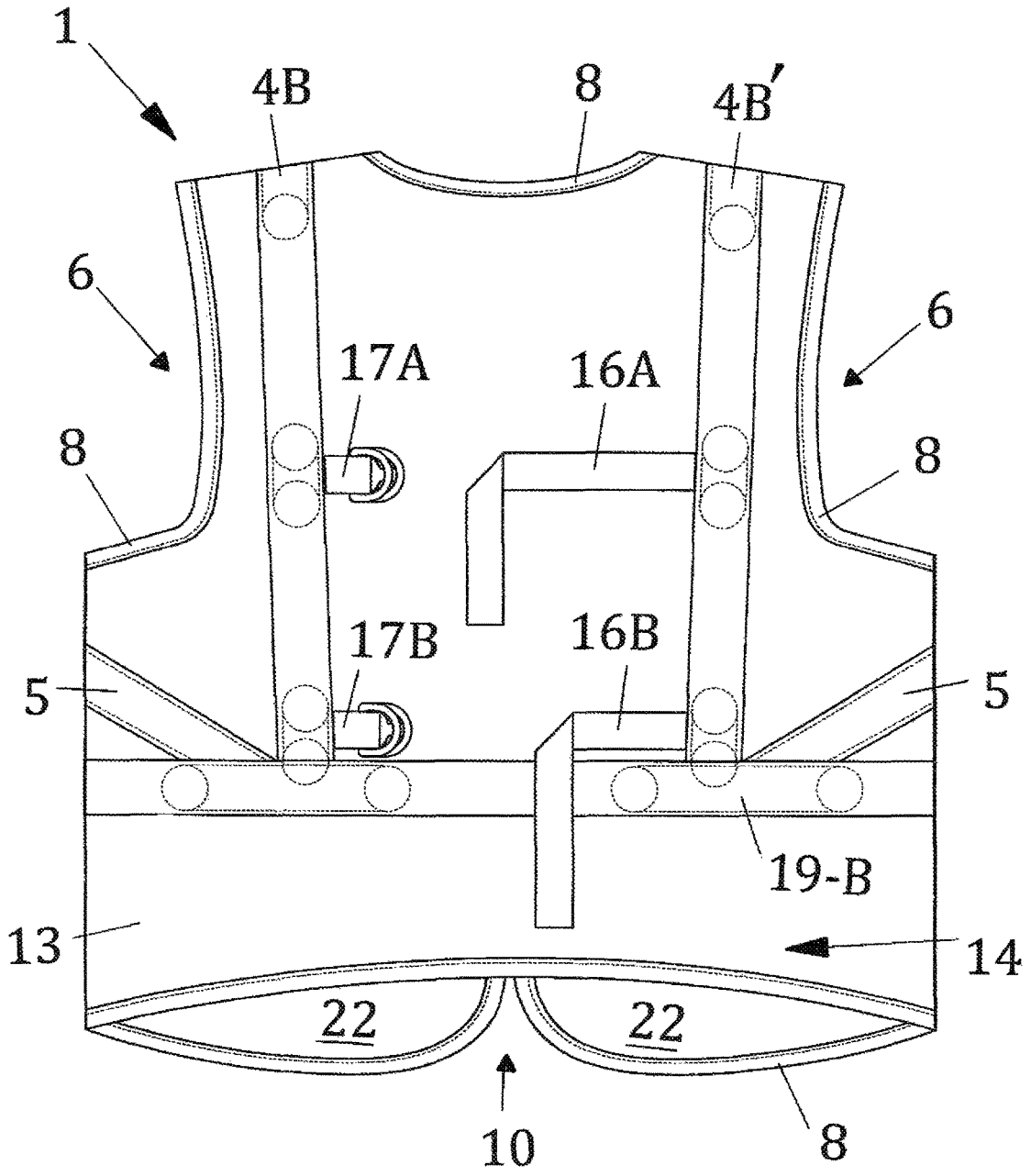
FIG. 3 is a rear view of the most preferred embodiment of the present invention with component numbering near the bottom of the illustration identifying a visible portion of the interior surface of the vest front material due to the length dimension of the vest back material being preferably shorter than that of the front vest material, FIG. 3 also shows two vertically-extending back straps each forming a pair of upper and lower non-adjustable hand grip components separated by an attached/strengthening non-hand-grip area, a horizontally-extending back strap positioned across the lower ends of the two vertically-extending back straps and assisting in firmly securing them to the vest back material, the horizontally-extending back strap further extending fully between the opposing sides of the vest back and preferably joined with the two horizontally-extending front straps as a single-piece strap component, the horizontally-extending back strap also having a central back hand grip component separated from each side hand grip component by an attached/strengthening non-hand-grip area, the vest back also having the lower portions of the two angled pressure/force distributing reinforcement straps securely attached to it while the upper ends of the angled reinforcement straps remain securely attached to the vest front as shown in FIGS. 1 and 2, each one of the angled reinforcement strap lower portions extending from a different side of the vest back material and downwardly toward the horizontally-extending back strap that overlays and secures its bottom end to the vest back material, in addition
Figure 5:
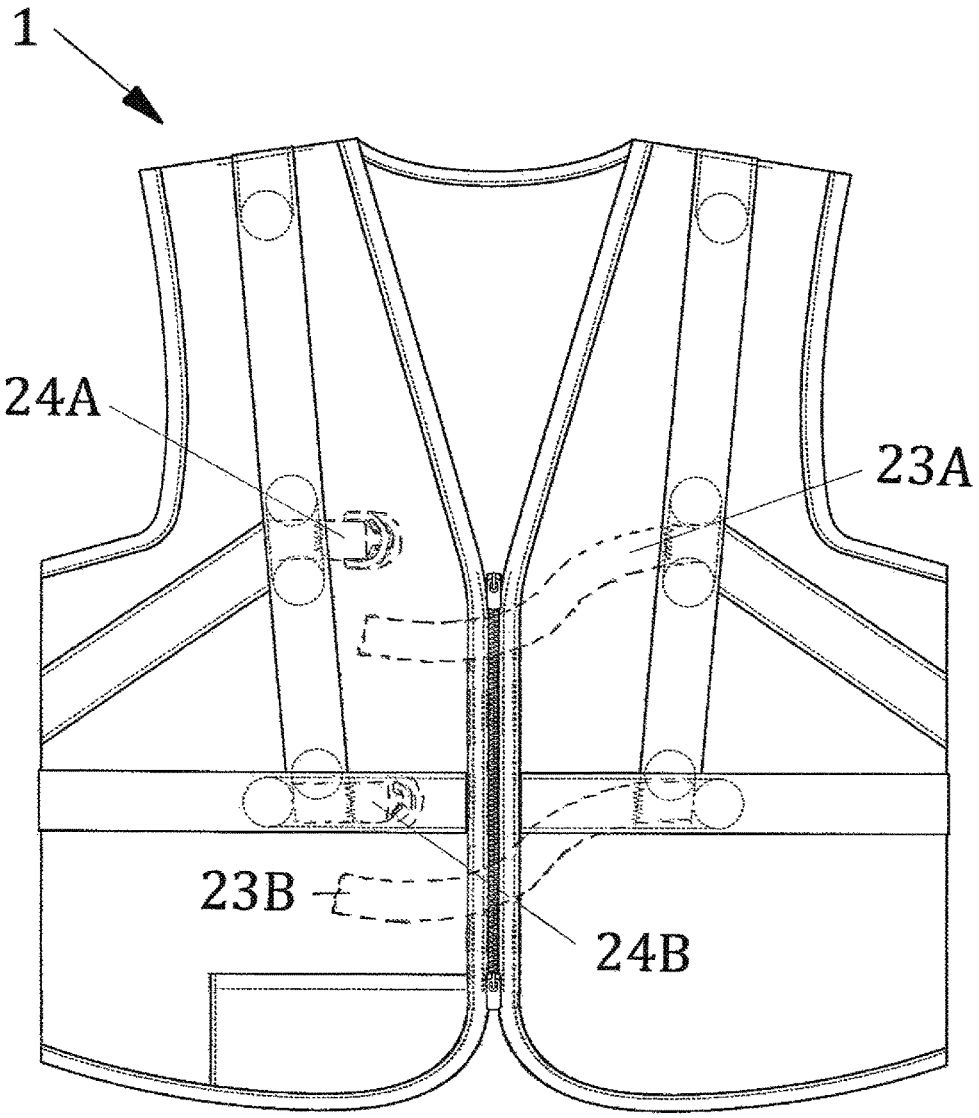
FIG. 5 is a front view similar to that shown in FIGS. 1 and 2, with the addition of inner front contour straps in broken lines to indicate they are typically hidden from view and two double D-ring assemblies each with a strap locking feature and secured to the front vest material with a different small tab in a location to engage a different front contour strap, the double D-ring assemblies and tabs also in broken lines to indicate their hidden positioning behind the front vest material.

FIGS. 1, 2, and 5 show structural details of the front portion of the most preferred embodiment of vest 1, while FIGS. 3 and 4 show structural details of the back portion of the most preferred embodiment of vest 1, with FIG. 6 showing an enlargement of one locking double D-ring assembly 17A secured to vertically-extending back strap 4B. Vest 1 is a preferably one-piece, sleeveless garment, with a double zippered front closure 3, that fits snugly and covers the patient's upper back, mid-chest, and waist areas, with back vest material 13 sufficiently shorter than front vest material 2 so that a patient does not even partially sit on any portion of back vest material 13 to avoid potential discomfort therefrom, and so that back vest material 13 does not interfere with the patient's use of a commode. The shortened back length of back vest material 13 is indicted by the number 14 in FIG. 3. In addition, as shown and identified in FIG. 2, four sturdy and durable vertically-extending, non-adjustable hand grip components (11-A, 11-B, 11-C, and 11-D) are secured to the front material 2 of vest 1, with two (11-A and 11-B) extending across the clavicle/upper chest area or shoulder area of a patient wearing it (each on a different side of double zippered front closure 3), and the other two (11-C and 11-D) also secured bilaterally to front vest material 2 and extending across the abdominal/mid-section area of the patient. In addition, and as also visible and identified in FIG. 2, in the most preferred vest 1 two horizontally-extending lateral/side/hip hand grip components (11-E and 11-F) are positioned bilaterally in its lower portion below the vertically-extending straps 4A and 4A', with one end of each horizontally-extending lateral/side/hip hand grip component (11-E and 11-F) firmly secured to front vest material 2 and the opposing end thereof firmly secured to back vest material 13 (as shown in FIG. 4). Also, in the most preferred embodiment of the present invention vest 1 and as shown and identified in FIGS. 2 and 4, circular stitching 9 defines the ends and length dimension of each hand grip component 11-A to 11-K. Furthermore, while in FIG. 2 a viewer will only see one area of circular stitching 9 (respectively 9-E and 9-J) in association with the two horizontally-extending front portions of the lateral/side/hip hand grip components (11-E and 11-F) formed respectively from horizontal strap portions 19A and 19'A (and defining their first opposing ends), the second area of circular stitching 9 (respectively 9-O and 9-X) for each front-to-back and horizontally-extending lateral/side/hip hand grip component (11-E and 11-F) (and defining their second opposed ends) is visible in FIG. 4.

Furthermore, as shown and identified by numbering in FIG. 4, the most preferred embodiment of vest 1 also has five more non-adjustable hand grip components (11-G, 11-H, 11-I, 11-J, and 11-K) secured to back vest material 13, four vertically-extending hand grip components (11-G, 11-H, 11-I, and 11-J), and a centrally-located horizontally-extending hand grip component 11-K, with the two upper vertically-extending hand grip components (11-G and 11-H) bilaterally extending across the upper back or shoulder area of the patient wearing it. For strengthening purposes, vest 1 also has angled reinforcement straps 5 (marked by the number 5 in FIGS. 1 and 3) each secured on one end by a different front strap portion (4A or 4A') between the two areas of circular stitching (9-B/9-C or 9-G/9-H) separating the clavicle and abdominal hand grip components (respectively separating 11-A from 11-C and separating 11-B from 11-D) bilaterally secured to the vest material 2 on opposing sides of the preferably double zippered front closure 3. From their connection on front vest material 2, FIGS. 1 and 2 show the two angled reinforcement straps 5 each angling downwardly and laterally away from double zippered front closure 3 in different directions, while FIGS. 3 and 4 show the opposing end of each angled reinforcement strap 5 being secured by the horizontally-extending back strap portion 19B on a different side of the centrally-located and horizontally-extending hand grip component 11-K (and in a position close to a different one of the following: lower back exterior contour strap 16B or lower back exterior double D-ring closure assembly 17B). As further shown and identified in FIGS. 1-4, reinforcing attachment stitching 12 is placed on angled reinforcement straps 5, and areas of vertically-extending straps 4A/4B and 4A'/4B', and horizontally-extending straps 19A, 19A', and 19B, where non-adjustable hand grip components 11 are not present. Furthermore, in FIGS. 1, 2, and 5 reinforcing attachment stitching 12 is shown securing the side of pocket 15 on one side of front vest material 2 near the lower end of double zippered front closure 3, with FIG. 2 also showing (and identifying by the number 12) the reinforcing attachment stitching securing double zippered front closure 3 and edge binding material 8 to front vest material 2.

Manual transfer vest 1 preferably comprises soft, durable, and flexible material to provide patient comfort, with stronger material used in larger sizes intended for heavier patients, as needed. In addition, it is preferred for front vest material 2 and back vest material 13 to be machine washable and machine dryable without shrinkage or excessive wrinkling. Although not shown, the edge binding material 8 surrounding armholes 6 and neck opening 7 may be padded for enhanced patient comfort, but such padding is not critical. No interior lining for front vest material 2 or back vest material 13 is contemplated or shown in the most preferred embodiment illustrated in FIGS. 1-6. However, it is considered within the scope of the present invention for a permanent or removable lining to be employed for added patient warmth in cold climates and/or in patient care facilities having patients easily chilled by air conditioning. The material from which hand grip components 11 are made should be non-stretchable, but also not overly firm to diminish caregiver hand comfort. In addition, the material used for straps 4, 4', and 19 should also be machine washable and machine dryable without shrinkage or excessive wrinkling/distortion for optimum caregiver hand comfort. Also material for straps 4, 4', and 19 preferably has a width dimension of approximately 1.5-inches. The thread used for reinforcement attachment stitching 12 and areas of circular stitching 9 also must be strong and durable after repeated wear and washings. Although not shown, reinforcement material may be used for attachment of locking double D-rings assemblies 17A/B and 24A/B, as well as contour straps 16A/B and 23A/B to front vest material 2 or back vest material 13, but is not critical.

The design and size of the most preferred embodiment of the manual transfer vest 1 should allow easy-on and easy-off handling, while also providing a comfortable fit on the person requiring transfer so that each transfer made is smooth and conducted with enhanced patent comfort. The most preferred embodiment of the present invention manual transfer vest 1 is also designed without gender preference, and is equally usable by both men and women without any modification. Manual transfer vest 1 may also be made in solid colors to complement patient clothing, or from materials that display a mixture of colors, textures, and/or designs for variety and/or enhanced aesthetic appeal, and although not shown, as a source of user convenience manual transfer vest 1 may comprise one or more exterior or interior pockets in various locations. Due to the need for a comfortable fit, as mentioned above, it is contemplated for manual transfer vest 1 to be made in a variety of sizes, such as but not limited to small, medium, large, and extra-large. Contour straps 16A/B and 23A/B could be important for patients expected to lose weight during a stay in a rehabilitative facility, so that a single vest 1 can be used during the entire rehabilitation with minor adjustments quickly made when periodically needed. As considered appropriate, large, extra large, and even greater sizes of vest 1 could have any of the eleven non-adjustable hand grip components 11-A to 11-K with a larger width dimension than is used for small and medium sizes, and the number, placement, size, and/or stitching pattern used for areas of circular stitching areas 9-A to 9-X could also be modified according to need from that illustrated herein in FIGS. 1-6, such as but not limited to one or more concentric circular stitching lines within, overlapping in part, or surrounding a circular stitching area 9, or a cross, star pattern, non-circular geometric shape, or irregular pattern of stitching within, overlapping in part, or adjacent to one or more circular stitching areas 9.

FIGS. 1, 2, and 5 are front views of manual transfer vest 1, with FIG. 1 having numbering that mainly identifies invention components, FIG. 2 having numbering that mainly identifies hand grip components 11, circular stitching 9, and non-circular stitching 12, and FIG. 5 showing preferred placement of inner contour straps 23A and 23B and the front inner double D-ring closure assemblies 24A and 24B which help to provide enhanced contour to vest 1 and a snug fit of vest 1 around the torso of a patient during assisted ambulation and transfers. Inner contour straps 23A and 23B and the front inner double D-ring closure assemblies 24A and 24B are shown in broken lines in FIG. 5 to indicate their interior positioning behind front vest material 2 (between the front torso of a patient and front vest material 2). FIGS. 1, 2, and 5 each show a double zippered front closure 3 and four frontal and substantially vertically-extending (and non-adjustable in length) hand grip components (11-A, 11-B, 11-C, and 11-D), two of which are upper hand grip components (11-A and 11-B) located on front vest material 2 in the clavicle/upper chest area each adjacent to a different shoulder of the person 16 wearing vest 1, and two of which are lower hand grip components (11-C and 11-D) located lower on front vest material 2 closer to the abdominal/mid-section area of the person 16 wearing it. FIGS. 1, 2, and 5 also show manual transfer vest 1 also having an area of circular stitching 9 adjacent to each end of each hand grip component 11 to strengthen it and make certain that hand grip components 11 maintain a secure attachment to vest 1 during the lifting of heavy patients and when patient lifting occurs from static and sometimes awkward positions. Hand grip components 11 should also be sufficiently large for an adult caregiver to comfortably insert all four fingers through it, but not too large so that the caregiver cannot establish proper leverage to assist the type of patient transfer needed.

FIGS. 1, 2, and 5 also show two angled reinforcement straps 5 each having one of its ends secured in place against front vest material 2 by a different front strap portion (4A or 4A') and stitching 12, and then continuing in a downward and lateral direction to the side of front vest material 2 while being secured in place against front vest material 2 by stitching 12 positioned close to each of its opposing side edges. Angled reinforcement straps 5 provide enhanced strength for vest 1 during patient transfers, particularly a sit-to-stand patient transfer. Although only one reinforcement strap 5 is shown on each side of manual transfer vest 1, it is considered to be within the scope of the present invention for more than one reinforcement strap 5 to be used, particularly in larger custom-ordered manual transfer vests 1. Furthermore, the attachment stitching 12 shown in FIG. 1 should not be considered as limiting, and the number of stitches-per-inch, placement, nearness to any material edge, stitching pattern, and the number of rows of attachment stitching 12 used in any location may be different from that shown and still considered within the spirit and scope of the present invention. Furthermore, for comfort of the person wearing it during stand-to-sit patient transitions, FIG. 1 shows manual transfer vest 1 having preferred enlarged arm holes 6, an enlarged neck opening 7, and a front void space 10 positioned below double zippered front closure 3. As also shown in FIG. 1, it is contemplated for front strap portions 4A and 4' to have substantially symmetrical placement laterally on front vest material 2 for even and steady transitions of the patient wearing vest 1. Also, the size of the areas of circular stitching 9 on front strap portions 4A and 4A' do not have to be the same size, although they can be. FIG. 1 also shows vest 1 having an optional pocket 15, the size, placement, configuration, and number of which is not limited to that shown in FIG. 1 (an may also include a second inner pocket). Furthermore, within the enlarged neck opening 7 of vest 1, FIG. 1 may show the upper inner front contour strap 23A when it is secured in place while engaging the locking double D-rings 17C of the upper front inner double D-ring closure assembly 24A, which together allow a good fit of vest 1 around a patient's torso, to provide proper mechanics during transfer/lift maneuvers.

FIGS. 3 and 4 are rear views of the most preferred embodiment of the present invention manual transfer vest 1, with FIG. 3 having numbering that mainly identifies invention components, FIG. 4 having numbering that mainly identifies hand grip components 11, circular stitching 9, and non-circular stitching 12. FIGS. 3 and 4 each show the two vertically-extending and non-adjustable upper hand grip components (11-G and 11-H) located in the upper back area of vest 1 adjacent to the shoulders of a person (not shown) wearing it, and the bottom edge 14 of vest back material 13 being shorter than front vest material 2 to prevent the discomfort that a person wearing it might otherwise experience should he/she inadvertently sit on a portion of it (and so that prior removal of vest 1 is not required during commode use). FIGS. 3 and 4 also show a horizontally-extending back strap 19B laterally secured with non-circular attachment stitching 12 to vest back material 13 in areas not intended to be hand grip components (11-E, 11-F, and 11-K), with non-circular attachment stitching 12 also extending across the lower ends of vertically-extending back strap portions 4B and 4B', which helps to strengthen the connection of the lower ends of back strap portions 4B and 4B' to vest back material 13 when transfer movement for a patient wearing vest 1 involves the use of either one of the hand grip components (11-G and 11-H) located on the portion of back strap components 4B and 4B' associated with the upper back or shoulders of the person wearing it. Furthermore, in FIGS. 3 and 4, the back portion of enlarged neck opening 7 and armholes 6 are all shown with attached edge binding material 8, which is preferred and may optionally include padding or soft surface texture for enhanced patient comfort. FIGS. 3 and 4 also show four areas of circular stitching 9 (9-O, 9-Q, 9-W, and 9-X) associated with horizontally-extending back strap 19B, and the space between the two center most areas of circular stitching 9 (9-Q and 9-W) containing no stitching 12, allowing that portion of back strap 19B to be used as central hand grip component 11-K. Thus, FIGS. 3 and 4 show reinforcement stitching 12 associated with all portions of vertically-extending back straps 4B and 4B', as well as all portions of horizontally-extending back strap 19B, that do not create a hand grip component 11. In addition, FIGS. 3 and 4 show two exterior back contour straps 16A and 16B each secured to extend across back vest material 13 to help provide a tapered and secure vest fit on a patient during transfer/lift maneuvers in association with the locking double D-rings 17C of the upper and lower back exterior double D-ring closure assemblies 17A and 17B. FIGS. 3 and 4 further show reinforcement stitching 12 associated with edge binding material 8. In addition, the number of stitches-per-inch, placement, nearness to any material edge, stitching pattern, and the number of rows of attachment stitching 12 used in any location in preferred embodiments of vest 1 may be different from that shown in FIGS. 3 and 4.

FIG. 5 is a front view of the most preferred embodiment of the present invention vest 1 showing the preferred positioning of inner front contour straps 23A and 23B both secured to front vest material 2 adjacent to the same vertically-extending strap (4A'). In the alternative and considered to be within the scope of the present invention, inner front contour straps 23A and 23B may both be secured to front vest material 2 adjacent to vertically-extending strap 4A, or inner front contour straps 23A and 23B each secured to a different vertically-extending strap 4A or 4A'. FIG. 5 also shows the two locking double D-rings assemblies 24A and 24B with which straps 23A and 23B engage to form a secure but comfortable fit of front vest material 2 and/or back vest material 13 around the torso of a patient. Although not shown, an optional fastening member, such as but not limited to hook-and-loop material, may be used to secure the ends of straps 16A, 16B, 23A, and 23B in a fixed position during use of vest 1. FIG. 6 shows an enlarged view of the connection of the preferred locking double D-rings 17C structure with which straps 23A and 23B engage to provide a non-slip gripping of a contour strap (16A, 6B, 23A or 23B.

To use the present invention, the patient (not shown) first dons manual transfer vest 1 and top inner front contour strap 23A and/or bottom inner front contour strap 23B are secured respectively via locking double D-rings assemblies 24A and 24B as needed for tightening correction around the torso of the patient. The double zippered front closure 3 of vest 1 is then secured so that manual transfer vest 1 completely enwraps the torso of the patient and provides a snug, but not too restrictive, fit around it. Should a slight tightening adjustment of vest 1 in the front be needed, top zipper pull 20A or bottom zipper pull 20B can be moved in the appropriate direction to reveal top inner front contour strap 23A or bottom inner front contour strap 23B for tightening correction. In the alternative, double zippered front closure 3 can be completely opened so that the proper fit adjustment can be more easily made. In the alternative, one or both of the exterior back contour straps 16A or 16B can be used with their respective locking D-ring assemblies 17A or 17B for tightening correction so that the proper transfer/lift maneuvers can be accomplished without risk of injury to patient or caregiver. Repeat fit adjustment of vest 1 with contour straps 16 and 23 can be conducted as many times as needed during a patient's use of vest 1.

For a frontal sit-to-stand transfer, a patient wearing vest 1 starts in a sitting position. Using good body mechanics, the caregiver (not shown) would stand with knees slightly bent and leaning slightly forward in front of the patient wearing vest 1. The caregiver would then place each of his or her hands within a different hand grip component 11 on opposite sides of double zippered front closure 3, and with ease and providing a controlled and gentle lift upward, the caregiver steadily assists the patient into a standing position. In contrast, for a lateral bed transfer, the caregiver would have the patient wearing vest 1 lie on his/her side and place both legs over the edge of the bed. Then with ease and control, the caregiver would use the appropriate hand grip component 11 (nearest the shoulder side down) to gently assist the patient to a sitting position. For a repositioning maneuver of a patient in bed, the caregiver would align and reposition the patient wearing vest 1 at the head of the bed by placing one hand in each of two different hand grip components 11 and with ease and control, gently pull the patient wearing vest 1 upward until positioned at the head of the bed. The repositioning maneuver using vest 1 can also be accomplished with a two-person assist. In addition, for promoting a steady gate during safe ambulation while walking along side of a patient wearing vest 1, the caregiver would place one hand through one hand grip component 11 (front or back), which would steady the gait of the patient, thereby reducing the risk of patient tripping or falling activity. This safe ambulation maneuver can also be accomplished by a two-person assist, with one person walking on each side of the patient wearing vest 1 and each holding onto one or more hand grip component 11 (front and/or back). Thus, it can be appreciated that with no direct patient-caregiver contact, vest 1 reduces the risk of patient skin tears, bruising, and joint dislocations during patient transfer and lifting maneuvers. Use of vest 1 also decreases the risk of shoulder, hand, wrist, and back strains experienced by caregivers due to the high physical demands of repetitive patient handling maneuvers.

We claim:

1. A manual transfer and lift garment allowing a caregiver to easily maneuver a patient from one position to another without direct caregiver contact with the patient's torso, arms, or legs, said garment comprising:

a vest having a front exterior surface, a front interior surface, and a back exterior surface, said vest also having two armholes, a front closure with closed positioning allowing said vest to have a torso-surrounding orientation, and a neck opening the front portion of which has a V-shaped configuration when said front closure adopts said closed positioning;

an elongated horizontally-extending strap secured in part via circular and non-circular stitching to said front exterior surface and also to said back exterior surface at a spaced-apart distance below said armholes, said horizontally-extending strap further having two opposed ends and substantially enwrapping said vest with each of said opposed ends positioned adjacent to said front closure, said areas between said circular stitching without said non-circular stitching forming two side horizontally-extending and non-length-adjustable hand grip components and one back horizontally-extending and non-length-adjustable hand grip component;

two elongated vertically-extending straps each having opposite ends, said vertically-extending straps each secured in part via circular and non-circular stitching bilaterally to said front exterior surface and said back exterior surface between a different one of said armholes and said neck opening, and also with said areas between said circular stitching without said non-circular stitching on each said vertically-extending strap forming four vertically-extending and non-length-adjustable hand grip components, two of said four becoming front hand grip components and two of said four becoming back hand grip components, said horizontally-extending strap also overlaying said opposite ends of said two elongated vertically-extending straps with said non-circular stitching securing said horizontally-extending strap to said front exterior surface and said back exterior surface, while concurrently securing said opposite ends of said two elongated vertically-extending straps to said front exterior surface and said back exterior surface;

an upper inner contour strap and a lower inner contour strap each having a distal end and a proximal end, said proximal end of said upper inner contour strap secured to said front interior surface of said vest at least in part by said non-circular stitching between said front hand grip components on one of said vertically-extending straps, said proximal end of said lower inner contour strap secured to said front interior surface of said vest at least in part by said circular stitching on one of said vertically-extending straps that is adjacent most in position to said horizontally-extending strap, said upper and said lower inner contour straps having horizontally-extending positioning during use to tighten said front vest material around a torso and achieve a tapered and secure fit of said vest around the patient while extending in part behind said front closure;

an upper pair of inner D-rings with at least one locking tab and a lower pair of inner D-rings with at least one locking tab, said upper pair of inner D-rings secured to said front interior surface of said vest at least in part by said non-circular stitching between said front hand grip components on the one of said vertically-extending straps in a position remote from said vertically-extending strap associated with said upper inner contour strap, said lower pair of inner D-rings secured to said front interior surface of said vest at least in part by said circular stitching on the one of said vertically-extending straps in a position remote from said vertically-extending strap associated with said lower inner contour strap, said upper and said lower pairs of inner D-rings respectively having positioning allowing engagement with said distal ends of said upper and said lower inner contour straps;

an upper exterior contour strap and a lower exterior contour strap each having a distal end and a proximal end, said proximal end of said upper exterior contour strap secured to said back exterior surface of said vest at least in part by said non-circular stitching between said back hand grip components on one of said vertically-extending straps, said proximal end of said lower exterior contour strap secured to said back exterior surface of said vest at least in part by said circular stitching on one of said vertically-extending straps that is adjacent most in position to said horizontally-extending strap, said upper and said lower exterior contour straps having horizontally-extending positioning during use to tighten said back vest material around a torso and achieve a tapered and secure fit of said vest around the patient while extending between said two vertically-extending straps;

an upper pair of exterior D-rings with at least one locking tab and a lower pair of exterior D-rings with at least one locking tab, said upper pair of exterior D-rings secured to said back exterior surface of said vest at least in part by said non-circular stitching between said back hand grip components on the one of said vertically-extending straps in a position remote from said vertically-extending strap associated with said upper exterior contour strap, said lower pair of inner D-rings secured to said back exterior surface of said vest at least in part by said circular stitching on the one of said vertically-extending straps in a position remote from said vertically-extending strap associated with said lower exterior contour strap, said upper and said lower pairs of inner D-rings respectively having positioning allowing engagement with said distal ends of said upper and said lower exterior contour straps; and two elongated angled reinforcement straps each having a first opposing end and a second opposing end, said first opposing end of each said angled reinforcement strap secured to said front exterior surface of said vest at least in part by said non-circular stitching between said front hand grip components on a different one of said vertically-extending straps while the adjacent most one of said vertically-extending straps overlays each said first opposing end helping to secure it to said front exterior surface, said second opposing end of each said angled reinforcement strap secured to said back exterior surface of said vest at least in part by a different one of said two areas of said non-circular stitching securing said horizontally-extending strap to said back exterior surface of said vest, said horizontally-extending strap overlays each said second opposing end helping to secure each said second opposing end to said front exterior surface and also laterally strengthen said back horizontally-extending hand grip component, with portions of each said angled reinforcement strap located between said first opposing end and said second opposing end extending in a downwardly direction from said front exterior surface of said vest to said back exterior surface of said vest while secured to said front and back exterior surfaces with non-circular stitching, wherein when said vest is worn by a patient with said front closure adopting said closed positioning to enwrap the patient's torso, said front and back hand grip components may be used by a caregiver in varying combinations for assisting patient ambulation to prevent falls, for patient movement and transfers, and to manually raise a patient from a seated position into a standing position, and further when said vest does not initially provide a tapered and secure fit around a patient appropriate for patient movement and transfers without injury to the patient or the patient's caregiver, at least one of said contour straps and one pair of said D-rings can be used in combination to achieve a tapered and secure fit of said vest around the patient.

2. The manual transfer and lift garment according to claim 1 further comprising at least one pocket associated with said front exterior surface of said vest.

3. The manual transfer and lift garment according to claim 1 wherein said front closure is a double-zippered closure with two zipper pulls in positioning opposed from one another when said front closure adopts said closed positioning that allows said double-zippered closure to open alternatively from the top down and from the bottom upward.

4. The manual transfer and lift garment according to claim 1 wherein each said contour strap has a minimum width dimension of approximately one-inch.

5. The manual transfer and lift garment according to claim 1 wherein said contour straps are made from non-stretchable material.

6. The manual transfer and lift garment according to claim 1 wherein said front and back hand grip components each have a minimum width dimension of approximately one-and-one-half inches.

7. The manual transfer and lift garment according to claim 1 wherein said back exterior surface has a shorter length dimension than that of said front exterior surface.

8. The manual transfer and lift garment according to claim 1 wherein said front exterior surface has a void space below said front closure.

9. The manual transfer and lift garment according to claim 1 wherein said arm openings are enlarged, promoting enhanced patient comfort.

10. The manual transfer and lift garment according to claim 1 wherein said neck area is enlarged, promoting enhanced patient comfort.

11. The manual transfer and lift garment according to claim 1 wherein said front exterior surface and said back exterior surface are made from material selected from a group consisting of breathable material, soft material, light-weight, machine washable material, machine dryable material, durable material, flexible material, sturdy material, phthalate-free material, and poly cotton twill material.

12. The manual transfer and lift garment according to claim 1 wherein each said D-ring has a free distal end and at least one non-slip locking tab associated with said free distal end.

13. The manual transfer and lift garment according to claim 12 wherein said free distal end has an interior surface and said non-slip locking feature is a split tab formed within said interior surface.

14. The manual transfer and lift garment according to claim 1 wherein said front exterior surface, said front interior surface, said back exterior surface, said two armholes, and said neck opening are all formed from one continuous piece of material.

15. A method allowing one caregiver to use the manual transfer and lift garment according to claim 1 for a frontal sit-to-stand transfer of a patient, said method comprising the steps of:

providing a garment according to claim 1, a caregiver, and a patient in a seated position;

placing said garment in said torso-surrounding orientation around said patient with the arms of said seated patient each extending through a different one of said armholes of said garment and said front closure in a vertically-extending position in front of said patient;

placing said front closure into said closed positioning;

if said garment has said tapered and secure fit around said patient, said caregiver standing with knees slightly bent and leaning slightly forward in front of said seated patient;

said caregiver grasping the uppermost one of said two vertically-extending front hand grip components on a first side of said front closure with a first hand;

said caregiver grasping the remaining uppermost one of said two vertically-extending front hand grip components on a second side of said front closure with a second hand; and said caregiver using both said hands to apply a controlled and gentle upward lifting force to said two grasped front hand grip components and steadily assist said patient into a standing position.

16. The method of claim 15 further comprising the following steps between said step of placing said front closure into said closed positioning and said step beginning with the word if:

opening said front closure;

using at least one of said inner front contour straps and at least one of said pairs of inner front D-rings to provide said tapered and secure fit of said garment around said patient while in said torso-surrounding orientation; and placing said front closure into said closed positioning.

17. The method of claim 15 further comprising the following step between said step of placing said front closure into said closed positioning and said step beginning with the word if:

using at least one of said exterior back contour straps and at least one of said pairs of exterior back D-rings to provide said tapered and secure fit of said garment around said patient while in said torso-surrounding orientation.

18. The method of claim 15 further comprising the following steps between said step of placing said front closure into said closed positioning and said step beginning with the word if:

opening said front closure;

using at least one of said inner front contour straps and at least one of said pairs of inner front D-rings to provide said tapered and secure fit of said garment around said patient while in said torso-surrounding orientation;

using at least one of said exterior back contour straps and at least one of said pairs of exterior back D-rings to provide said tapered and secure fit of said garment around said patient while in said torso-surrounding orientation; and placing said front closure into said closed positioning.

19. The method of claim 18 wherein said step of using at least one of said exterior back contour straps and said step of placing said front closure into said closed positioning have reversed order.

20. A method allowing two caregivers to use the manual transfer and lift garment according to claim 1 for a frontal sit-to-stand transfer of a patient, said method comprising the steps of:

providing two caregivers and a seated patient wearing said manual transfer and lift garment according to claim 1 wherein said tapered and secure fit in said torso-surrounding orientation is achieved;

each said caregiver standing on a different side of said patient;

each said caregiver grasping the adjacent most one of said two uppermost vertically-extending front hand grip components and also grasping the adjacent most one of said two uppermost vertically-extending back hand grip components; and each said caregiver in unison with one another using said adjacent most ones of said uppermost vertically-extending front and back hand grip components to apply a controlled and gentle upward lifting force and steadily assist said patient into a standing position.

* * * * *